US007063112B2

(12) United States Patent
Fink, Jr. et al.

(10) Patent No.: US 7,063,112 B2
(45) Date of Patent: Jun. 20, 2006

(54) FUEL DISPENSING NOZZLE HAVING A DRIPLESS SPOUT

(75) Inventors: Arthur C. Fink, Jr., Lonedell, MO (US); Jeff Deaton, St. Louis, MO (US)

(73) Assignee: Husky Corporation, Pacific, MO (US)

( * ) Notice: Subject to any disclaimer, the term of this patent is extended or adjusted under 35 U.S.C. 154(b) by 0 days.

(21) Appl. No.: 11/081,407

(22) Filed: Mar. 16, 2005

(65) Prior Publication Data

US 2005/0205155 A1 Sep. 22, 2005

Related U.S. Application Data

(60) Provisional application No. 60/554,270, filed on Mar. 17, 2004.

(51) Int. Cl.
*B65B 1/04* (2006.01)

(52) U.S. Cl. ..... 141/311 A; 141/2; 141/286; 141/389; 141/392; 222/571

(58) Field of Classification Search ..... 141/2, 141/59, 128, 206, 285, 286, 382, 387, 389, 141/311 A, 392; 222/108, 571
See application file for complete search history.

(56) References Cited

U.S. PATENT DOCUMENTS 5,127,451 A 7/1992 Fink, Jr. et al.
5,178,197 A * 1/1993 Healy ..... 141/217
6,854,491 B1 * 2/2005 Knight et al. ..... 141/59

* cited by examiner

*Primary Examiner*—Timothy L. Maust
(74) *Attorney, Agent, or Firm*—Paul M. Denk

(57) ABSTRACT

A fuel dispensing nozzle having a dripless spout has a nozzle for placement in a tank. The nozzle has a housing with an air bleed device, an attitude support device extends from the housing, a gland joined to the attitude support device and then the spout attaches to the gland. At fuel shutoff, fuel remains in the gland and the spout. Fuel drops exit the gland then the spout. Regulations limit the drops to three or less. Smooth tubes have little if any capillary action while tubes with roughened interior surfaces retain fluid. The dripless spout has a texture applied to the interior surface of the gland, the spout, or both by way of a screen; a hole in the attitude support device; and the air bleed device located in the vapor path to reduce negative vacuum.

4 Claims, 2 Drawing Sheets

FUEL DISPENSING NOZZLE HAVING A DRIPLESS SPOUT

CROSS REFERENCE TO RELATED APPLICATION

This nonprovisional patent application claims priority to the provisional patent application having Ser. No. 60/554,270, which was filed on Mar. 17, 2004.

BACKGROUND OF THE INVENTION

The fuel dispensing nozzle having a dripless spout relates to nozzles used to dispense gasoline into automobile fuel tanks in general and more specifically to improvements in the spout, the gland, the attitude support device, and the air bleed device to reduce the drops of fuel after fueling. A unique aspect of the present dripless spout is a texture applied to the interior surface of the spout and a hole in the attitude support device.

Well known in the art and the public, gasoline-dispensing nozzles of the type used in most service stations have a spout which is inserted into the inlet of the filler pipe of an automobile fuel tank. The diameter of the spout is less than that of the filler pipe resulting in a gap between the side of the spout and the filler pipe. Consequently, gasoline vapors escaped into the atmosphere. Escaped gasoline vapors raised pollution concerns and triggered government regulation of fuel dispensing nozzles. Regulations require such nozzles to reduce the pollutants released to the atmosphere. A flexible bellows assembly fitted over the spout meets the regulations. This is known as the balanced pressure nozzle. However, the regulations further address drops of fuel that exit the spout after fueling. A user releases a lever to stop fuel flow into the nozzle. Some fuel remains within the nozzle and the spout. Under gravity, the fuel exits the spout as drops and evaporates. The California Air Resources Board limits nozzles to no more than three drops emitted from a spout after fueling.

Prior art designs provided valves at the end of the spout to block drops. Though stopping the fuel drops, valves added to the weight and cost of a nozzle. Valves tended to corrode and to malfunction after substantial usage.

The present art overcomes the limitations of the prior art. That is, the art of the present invention, a dripless spout, retains fuel drops within the spout without a valve.

The difficulty in providing a dripless spout is shown by the operation of a typical nozzle. A user completes fueling and releases a lever on a nozzle. The nozzle retains fuel in the spout and internal parts of the nozzle that has not dispensed into an automobile's fuel tank. As the user replaces the nozzle at the pump, fuel follows gravity towards the distal end of the spout. The fuel encounters a valve that closes automatically upon release of the lever. Fuel forms drops beyond the valve at the distal end of the spout. As the valve wears, more fuel escapes and forms drops. The present invention overcomes these difficulties.

The use of nozzles to dispense fuel is known in the prior art. For example, the U.S. Pat. No. 5,127,451 to Fink and Mitchell discloses a fuel dispensing nozzle improvement of a bellows to trap fuel vapors during filling of a tank. The bellows surrounds the spout for its full length and captures vapors. However, upon nozzle shutoff, fuel remains in the spout by capillary attraction or otherwise. The undisclosed surface of the spout permits fuel to exit the spout as drops. Thus, the prior art type of devices do not provide for reducing the number of fuel drops leaving a nozzle.

SUMMARY OF THE INVENTION

A fuel dispensing nozzle having a dripless spout begins with a nozzle for dispensing fuel into automobile tanks and the like. The nozzle controls fuel delivery with a lever connected to a housing. A gland extends from the housing and a spout attaches to the gland. At fuel shutoff, some fuel remains beyond the housing in the gland and the spout, and in open areas of the internal components of the spout. Further, the sudden shut-off of the nozzle causes a negative vacuum in the spout resulting in fuel rebound inside the spout due to the inertia of the fuel flow. Gravity draws out remaining fuel as drops. Regulations limit the drops to three or less in number. Capillary action retains fluids on the interior surface of a tube. First, smooth bore tubes have little if any capillary action while tubes with roughened interior surfaces retain fluid. This dripless spout has a texture applied to the interior surface of the gland, the spout, or both. In the preferred embodiment, the texture is a mesh screen, 40×40 mesh, more or less, formed into a hollow cylinder and inserted upon the interior surface of a gland. In an alternate embodiment, the texture is applied to the interior surface of the nozzle by chemical or mechanical means.

Second, ahead of the gland within the nozzle, fuel became trapped in the front and back pockets of the attitude support device. Normally used for the ball device of the attitude support, a cap also blocked off the front pocket. Initially for the check valve stem, the back pocket had a hole drilled in the back pocket. The hole allowed trapped fuel to drain when the nozzle shut off with the spout oriented down in the fill-neck of a tank. In the preferred embodiment, the hole has a $\frac{1}{8}^{th}$ inch diameter and a location in the bottom wall of the pocket.

Third, ahead of the attitude support and proximate to the connection of the fuel hose to the housing, a negative vacuum reaches the air bleed device. The negative vacuum causes fuel to rebound into the spout and drip under gravity. Open to vapors and installed in the vapor path, the air bleed device reduces the negative vacuum in the spout induced by shutoff of the nozzle. In operation, the air bleed device limited fuel rebound and the fuel exited the spout without leaving fuel any behind. The preferred embodiment has a nylon tube and matching fittings for the air bleed device.

DESCRIPTION OF THE PREFERRED EMBODIMENT

Figure 1:
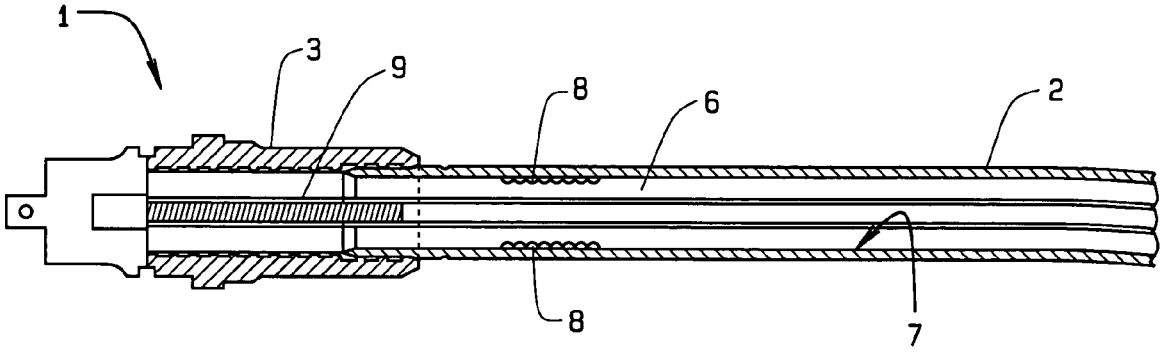
FIG. 1 shows a sectional view of the preferred embodiment of the fuel dispensing nozzle having a dripless spout constructed in accordance with the principles of the present invention.

The present art overcomes the prior art limitations by providing a textured surface within a spout, a hole in an attitude support device, and an air bleed device in the vapor path. Turning to FIG. 1, the preferred embodiment of the fuel dispensing nozzle 1 having a dripless spout 2 is shown as the left half of a nozzle 1. The spout 2 has a round hollow tubular form with a cant towards the distal end of the spout 2. When assembled with a handle [not shown], the spout 2 delivers fuel through the distal end. Opposite the distal end, the spout 2 has a gland 3. The gland 3 connects the spout 2 to an attitude support device 11 and then to a housing [not shown]. Centered within the spout 2 and the gland 3, a vent tube 9 collects vapors utilized for automatic shutoff from the distal end and returns vapors to the fueling line (not shown).

The steel spout 2 has an interior surface 7 upon which fuel passes during delivery. The interior surface 7 extends the length of the spout 2 and the inside diameter of the spout 2. In the preferred embodiment, the interior surface 7 has a smooth finish. In an alternate embodiment, the interior surface 7 has a texture 8 applied. The texture 8 may be applied by chemical etching, sand blasting, manual sanding, and machine finishes such as grooves, threads, or knurls. The texture 8 may extend partially or fully along the length of the spout 2.

Generally cylindrical, the gland 3 has a hollow center that fits snugly over the proximate end of the spout 2. The gland 3 is aluminum and has an interior surface 5 upon which fuel passes into the spout 2. In the preferred embodiment, the gland 3 has a cylindrical screen 4 inserted within the gland 3 and upon the interior surface 5 for the entire inside circumference. In an alternative embodiment, the gland 3 is nylon. In a further alternative embodiment, the gland 3 is steel. The screen 4 provides texture 8 within the gland 3 to retain fuel drops. The screen 4 is formed from 40×40 stainless steel mesh with a straight parting line. In an alternate embodiment, the screen 4 has an irregular parting line. In a still further alternate embodiment, the screen 4 has round wire or square wire. In another further embodiment, the screen 4 has weaving such as knitted hex, square, dutch, double, triple, twilled, twilled dutch, and the like. In another further embodiment, the screen 4 comes from a perforated sheet with round, rectangular, square, oblong, elliptical and the like holes. In another further embodiment, the screen 4 takes a form such as a honeycomb extending across the diameter of the gland 3, an alternating crimped ring, a tightly coiled wire akin to a spring, a helical insert and the like.

Figure 2:
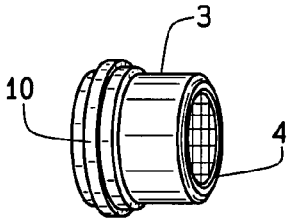
FIG. 2 shows a perspective view of the gland with a screen as the preferred embodiment of the dripless spout.

Viewing FIG. 2, the cylindrical gland 3 has a hollow center, thin wall, and one or more circumferential flanges 10. In the preferred embodiment, the screen 4 is located upon the interior surface of the gland 3. The screen 4 extends for the length and the inside circumference of the gland 3.

Figure 3:
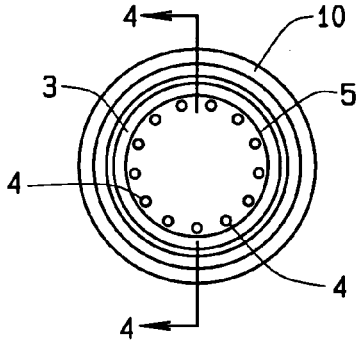
FIG. 3 shows an end view of the gland with the screen installed for the dripless spout.

Turning to FIG. 3, the gland 3 has a round shape in section and the screen 4 extends for the inside circumference of the gland 3. The flanges 10 are arranged concentrically near the proximal end of the gland 3.

Figure 4:
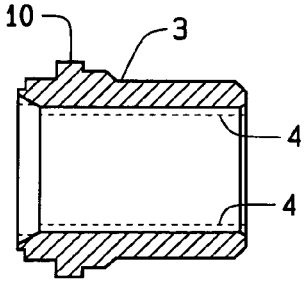
FIG. 4 illustrates a sectional view of the gland with screen for the dripless spout.

Then FIG. 4 shows a longitudinal section of the gland 3 with the screen 4 installed upon the interior surface of the gland 3 for the length of the gland 3.

Figure 5:
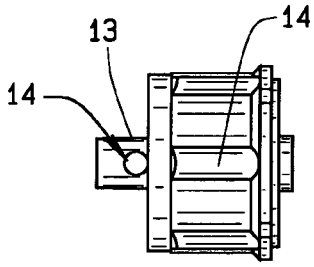
FIG. 5 shows a bottom plan view of the attitude support device.

Turning to FIG. 5, the attitude support device 11 installs in the nozzle 1 between the gland 3 and the housing. The attitude support device 11 has a generally round shape to accommodate the gland 3 and a front pocket 12 and an opposite back pocket 13. The front pocket 12 is off center of the attitude support device 11 and has a cap to close the front pocket 12 from the vent tube 9. The back pocket 13 is generally cylindrical, centered upon the attitude support device 11, and extends perpendicular from the attitude support device 11 and in line with the vent tube 9. To release fuel trapped in the front pocket 12 and the back pocket 13, the back pocket 13 has a drilled hole 14 perpendicular to the axis of the back pocket 13. The hole 14 is located upon the bottom of the back pocket 13 to permit fuel drainage by gravity into the spout 2.

Figures 6, 7:
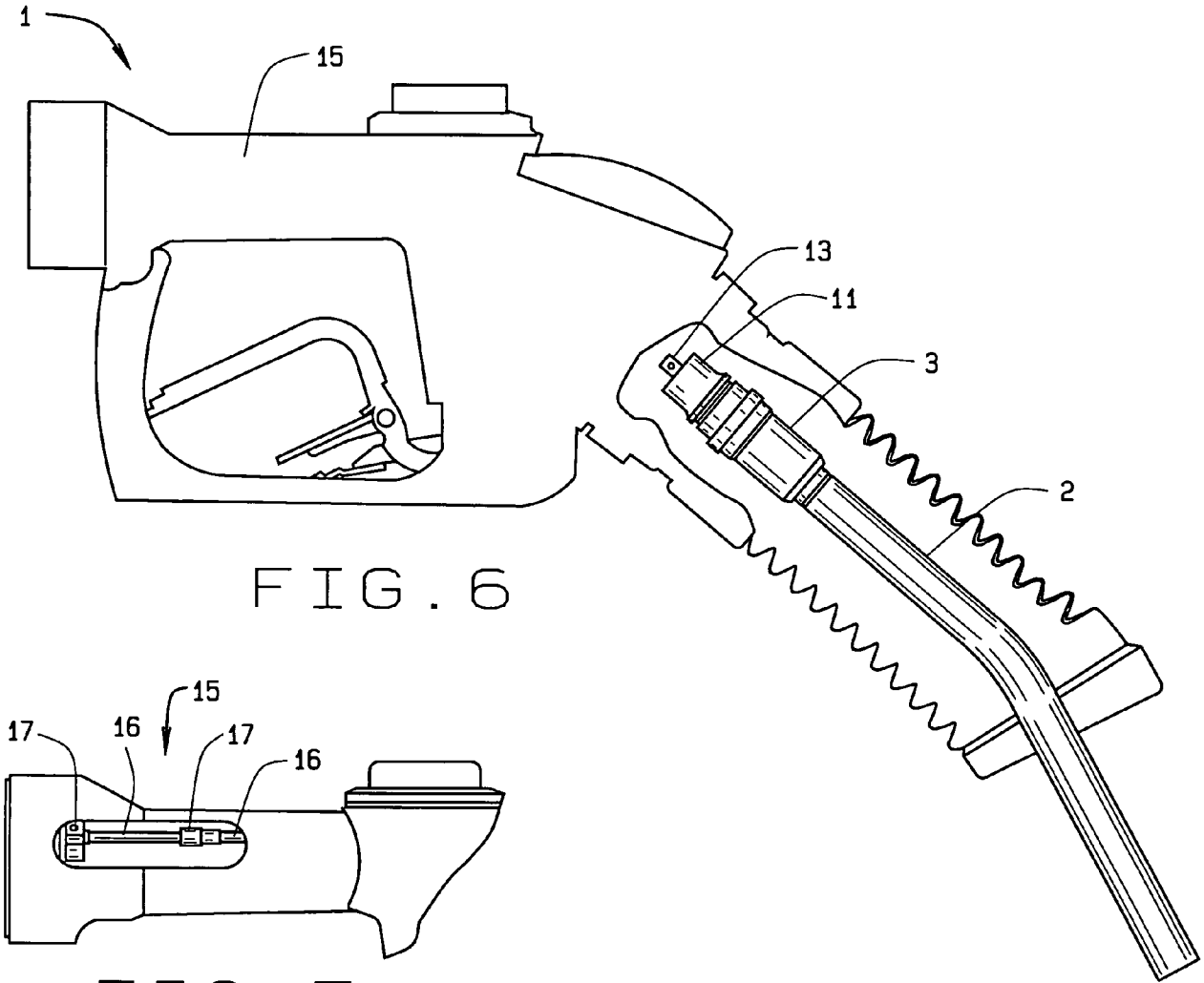
FIG. 6 describes the fuel dispensing nozzle having a dripless spout showing the location of the air bleed device constructed in accordance with the principles of the present invention; and, FIG. 7 illustrates the air bleed device in a detailed view of the fuel dispensing nozzle having a dripless spout.

Then in FIG. 6, the fuel dispensing nozzle 1 has drip preventing features located throughout. Within the bellows, the attitude support device 11 joins the housing and the gland 3 joins to the attitude support device 11. In particular, the back pocket 13 has fluid communication with the housing and the gland 3 has fluid communication with the spout 2. The air bleed device 15 has a location within the housing opposite the handle and in line with the fuel flow.

Moving to FIG. 7, within the housing, the air bleed device 15 has an orientation parallel to the flow of fuel. The air bleed device 15 is one or more nylon tubes 16 connected by coaxial fittings 17 to the fuel hose (not shown) and to the housing. The air bleed device 15 maintains communication with the vent tube 9 through the housing to transmit vapors from the fuel dispensing at the distal end of the spout back to the fuel hose (not shown).

To utilize the present art, a person forms 40×40, more or less, stainless steel mesh into a hollow cylindrical shape with the length of the gland 3. The person inserts the mesh into the gland 3, flush with each end and resting upon the interior surface 5 of the gland 3. The person then inserts the proximal end of the spout 2 into the gland 3 and within the screen 4 so the flanges 10 are opposite of the spout 2. In the alternate embodiment, the person applies the texture 8 to the interior surface 7 of the spout 2 at least partially along the length of the spout 2 by the means listed above for FIG. 1.

Next, a person grasps the attitude support device 11 and rotates the attitude support device 11 so the cap is upward and towards the person. The person then drills a $\frac{1}{8}^{th}$ inch diameter hole in the back pocket 13, generally centered upon the length and width of the back pocket 13. The person then rotates the attitude support device 11 so that the hole 14 faces away and generally downward. The person joins the front pocket 12 to the gland 3 with the front pocket 12 rotated so the cap is closest to the housing.

Then, a person connects one or more tubes 16 to the housing and to the fuel hose (not shown) with fittings 17 to form the air bleed device. Vapors pass from the housing through the air bleed device 15 to the fuel hose.

From the aforementioned description, a dripless spout has been described. The dripless spout is uniquely capable of retaining fuel within a spout to prevent drops from exiting the spout and evaporating. The dripless spout and its various components may be manufactured from many materials including but not limited to stainless steel mesh, polymers, high density polyethylene HDPE, polypropylene PP, polyethylene terephalate ethylene PETE, polyvinyl chloride PVC, polystyrene PS, nylon, ferrous and non-ferrous metals, their alloys, and composites.

The invention claimed is:

1. A nozzle for dispensing fuel into a vehicle tank having a spout connected to a gland joined to an attitude support device and then joined to a nozzle housing with an air bleed device in fluid communication therewith for fuel to flow from the nozzle into the housing and through the attitude support device and gland then into and through said spout for delivery into said tank wherein the improvement comprises:

said gland having a hollow cylindrical shape and an interior surface;

a screen having a hollow cylindrical shape and applied proximate to the interior surface of said gland;

said attitude support device having a front pocket and an opposite back pocket, said back pocket having a hole to permit drainage of fuel;

said air bleed device having one or more tubes connected by fittings to said nozzle housing; and, said spout having a generally hollow tube, an interior surface, and a texture applied to said interior surface.

2. The nozzle of claim 1 further comprising said texture selected from the group consisting of chemical etching, sand blasting, manual sanding, and machined finishes.

3. The nozzle of claim 2 further comprising said machined finishes selected from the group consisting of grooves, threads, or knurls.

4. A method to impede fuel, preventing drips from a spout in fluid communication with a gland, an attitude support device, and an air bleed device as part of a nozzle, the steps comprising:

applying a texture to the interior surface of said spout or said gland or both, wherein capillary action of said texture upon the interior surface retains fuel after shutoff of said nozzle;

drilling a hole in said attitude support device to permit fuel to drain from said device; and, reducing the negative vacuum in said spout with an air bleed device located in the vapor path.

* * * * *